US005240379A

United States Patent [19]

Takashi et al.

[11] Patent Number: 5,240,379

[45] Date of Patent: Aug. 31, 1993

[54] HYDRAULIC POWER UNIT

[75] Inventors: Homma Takashi; Endoh Toshihiro; Wakiya Michio, all of Higashimatsuyama, Japan

[73] Assignee: Zexel Corporation, Tokyo, Japan

[21] Appl. No.: 915,504

[22] Filed: Jul. 20, 1992

[30] Foreign Application Priority Data

Jul. 19, 1991 [JP] Japan ..... 3-203486

[51] Int. Cl.[5] ..... F04B 49/08

[52] U.S. Cl. ..... 417/38; 417/44; 417/63; 303/DIG. 4

[58] Field of Search ..... 417/38, 44, 63; 303/11, 303/DIG. 3, DIG. 4

[56] References Cited

U.S. PATENT DOCUMENTS 4,357,054 11/1982 Leiber ..... 303/DIG. 4
4,728,156 1/1988 Burgdorf et al. ..... 303/DIG. 4

FOREIGN PATENT DOCUMENTS 0310113 4/1989 European Pat. Off. .
3509335 10/1986 Fed. Rep. of Germany .
2633339 6/1988 France .
2042645 9/1980 United Kingdom .
2182103 5/1987 United Kingdom .

*Primary Examiner*—Richard A. Bertsch
*Assistant Examiner*—David W. Scheuermann
*Attorney, Agent, or Firm*—Sughrue, Mion, Zinn, Macpeak and Seas

[57] ABSTRACT

A hydraulic power unit for a vehicle comprises a motor, a pump to be driven by the motor to pump up an oil stored in an oil tank, a gas filling type accumulator connected to the pump, a pressure sensor disposed at a portion near an outlet port of the accumulator for detecting a pressure of the oil in the accumulator, a control unit operatively connected to the pressure sensor and a relay opertively connected to the control unit for controlling an operation of the motor. In the control unit, a rate of change of the pressure of the oil detected by the pressure sensor is calculated with respect to transition of time, an inflection point at which the rate of change of the oil pressure at a time of control start time or control stop time of the hydraulic power unit is maximumly changed is obtained, an oil pressure at the inflection point is calculated, the oil pressure at the inflection point is compared with a predetermined oil pressure, and a fact as to whether or not the oil pressure at the inflection point reaches the predetermined oil pressure is discriminated.

9 Claims, 8 Drawing Sheets

9
B
C
A
T
P
P
T
24R
135
PU
P
T
13
5
25
11
3
1
7
19
19a
23
21
17

HYDRAULIC POWER UNIT

BACKGROUND OF THE INVENTION

The present invention relates to a hydraulic power unit for a vehicle, for example, capable of detecting an abnormal condition of a pressure of a gas filling in an accumulator of the hydraulic power unit.

In general, a vehicle such as an automobile is provided with a mechanically operatable speed changing apparatus which is electronically controlled. Such speed changing apparatus includes various kinds of actuators which are driven by a hydraulic power unit, and one typical example thereof is shown in FIG. 8.

Referring to FIG. 8, a hydraulic power unit is designated by a symbol PU which generally includes a motor 1, a gear pump 3, and a gas filling type accumulator 5, in which the gear pump 3 is driven by the motor 1 to pump up an oil from an oil tank 7 and the thus pumped-up oil is supplied to an actuator means 9 operatively connected to the hydraulic power unit PU. The actuator means 9 includes a clutch changing cylinder A, a shift changing cylinder B and a select changing cylinder C all of which are operated hydraulically and are adapted for a mechanically operatable speed changing apparatus. In the hydraulic power unit PU, a check valve 11 is incorporated in a line between the gear pump 3 and the accumulator 5 and a shift valve 13 is also incorporated in a line branched from the line connecting the gear pump 3 and the accumulator 5.

The hydraulic power unit PU of this conventional type is disclosed, for example, in the Japanese Utility Model Laid-open Publication No. 60-10901, in which the motor 1 is not always driven even during the operation of the actuator means 9. Namely, when a predetermined hydraulic, i.e. oil, pressure is accumulated in the accumulator 5, the operation of the motor 1 is once stopped at this moment and, during this motor operation stopping period, the actuator means b 9 is driven by the oil pressure accumulated in the accumulator 5, and on the contrary, when the oil pressure in the accumulatior 5 is lowered to or below the predetermined value, the motor 1 is again driven to thereby operate the accumulator.

Namely, as shown in FIGS. 8 and 9, a pressure detection switch 15 is incorporated to a line extending from an outlet port of the accumulator 5, and accordingly, the pressure detected by the pressure detection switch 15 is deemed as an accumulated pressure in the accumulator 5. When this accumulated pressure reaches a high level $P_H$, for example, a contact 15*a* of the pressure detection switch 15 is opened to thereby deenergize a relay 19 through a control unit 17 and hence to open a contact 19*a* of the relay 19, thus stopping the operation of the motor 1. When the oil in the accumulator 5 is consumed gradually and the pressure therein has reached a low level $P_L$, for example, the contact 15*a* of the pressure detection switch 15 is closed to thereby establish an electrical conduction to the relay 19 through the operation of the control unit 17 and hence to close the contact 19*a* of the relay 19, thus operating the motor 1. In FIG. 8, reference numeral 21 denotes a battery and 23 is a key switch.

During this operation, the actuator means 9 is operated, and as shown in FIG. 9, when the actuator means 9 is not operated, the operation of the motor 1 is also stopped and the pressure in the hydraulic line in the system can be maintained to the high pressure level $P_H$.

In the above arrangement of the conventional hydraulic power unit of a vehicle, for example, since a pressure detected by a pressure detection switch 15 which is arranged at portion near to the outlet port of the accumulator 5 is deemed as an accumulated pressure in the accumulator 5, when an abnormal condition of the gas pressure in the accumulator occurs, a precise pressure control will not be expected. For example, when the gas pressure in the accumulator is abnormally lowered, the oil amount accumulated in the accumulator 5 is reduced over the pressure (i.e. pressure level $P_L$) necessary for driving the acutuator means 9, and accordingly, the switching operation, that is on-off operation, of the motor 1 is increased in its frequency, thus providing a problem. Moreover, in the conventional arrangement, since the gas pressure in the accumulator 5 is not detected, it is difficult for a driver of a vehicle to be notified with such pressure abnormal. Such pressure abnormal will adversely affect a speed changing performance of a clutch when such hydraulic power unit is applied to the vehicle such as an automobile.

SUMMARY OF THE INVENTION

An object of the present invention is to substantially eliminate defects or drawbacks encountered in the prior art arrangement and to provide a hydraulic power unit adapted for a vehicle, for example, capable of easily detecting an abnormal condition of gas pressure in an accumulator and controlling the power unit with high performance.

In general, at the operation starting period of the hydraulic power unit, the hydraulic, i.e. oil, pressure in a circuit of the unit rapidly increases at the initial stage of the operation and then gently increases upon the arrival to a pressure substantially corresponding to the pressure of the gas filling in the accumulator. Furthermore, at the operation stopping period, i.e. key switch "OFF" period, the oil in the accumulator is all released into the oil tank, but in such case, the oil pressure gently decreases till the time when the accumulated oil pressure has reached a pressure corresponding to the gas pressure in the accumulator and then rapidly decreases upon the arrival to the gas pressure.

The present invention was conceived by taking the above object and facts into consideration to detect the abnormal condition of the gas pressure in the accumulator, and according to the present invention, there is provided a hydraulic power unit comprising:

a motor;

a pump to be driven by the motor to pump up an oil stored in an oil tank, a gas filling type accumulator connected to the pump through a line so as to supply the oil from the pump;

a pressure detecting means disposed at a portion near an outlet port of the accumulator for detecting a pressure of the oil in the accumulator;

a control unit operatively connected to the pressure detecting means; and a relay means operatively connected to the control unit for controlling an operation of the motor, the control unit including means for calculating a rate of change of the pressure of the oil detected by the pressure detecting means with respect to transition of time, means for obtaining an inflection point at which the rate of change of the oil pressure at a time of control start time or control stop time of the hydraulic power unit is maximumly changed and calculating an oil pressure at the inflection point and means for compairing the oil pressure at the inflection point with a predetermined oil pressure and discriminating a fact as to whether or not the oil pressure at the inflection point reaches the predetermined oil pressure.

In preferred embodiments, the pressure detecting means comprises an electrostatic capacitance type pressure intershifter. The oil pressure control by means of the control unit is performed in connection with a gas pressure in the accumulator. The gas pressure in the accumulator corresponds to the predetermined oil pressure in an ordinary or normal operation period of the accumulator. The pressure control is performed by utilizing characteristic features at a control start or stop time.

According to the present invention of the characters described above, by utilizing the characteristic features of the oil pressure at the operation start or stop time period of the hydraulic power unit, the oil pressure in the accumulator is detected by the pressure sensor and the rate of change of the thus detected oil pressure with respect to the transition time is continuously calculated to then obtain an inflection point at which the rate of change is maximumly changed. The oil pressure at this inflection point is calculated and then compared with the predetermined value in connection with the gas pressure in the accumulator. When the pressure does not reach the predetermined value, an alarm is generated to inform an abnormal condition of the gas pressure in the accumulator.

DESCRIPTION OF THE PREFERRED EMBODIMENT

Figure 8:
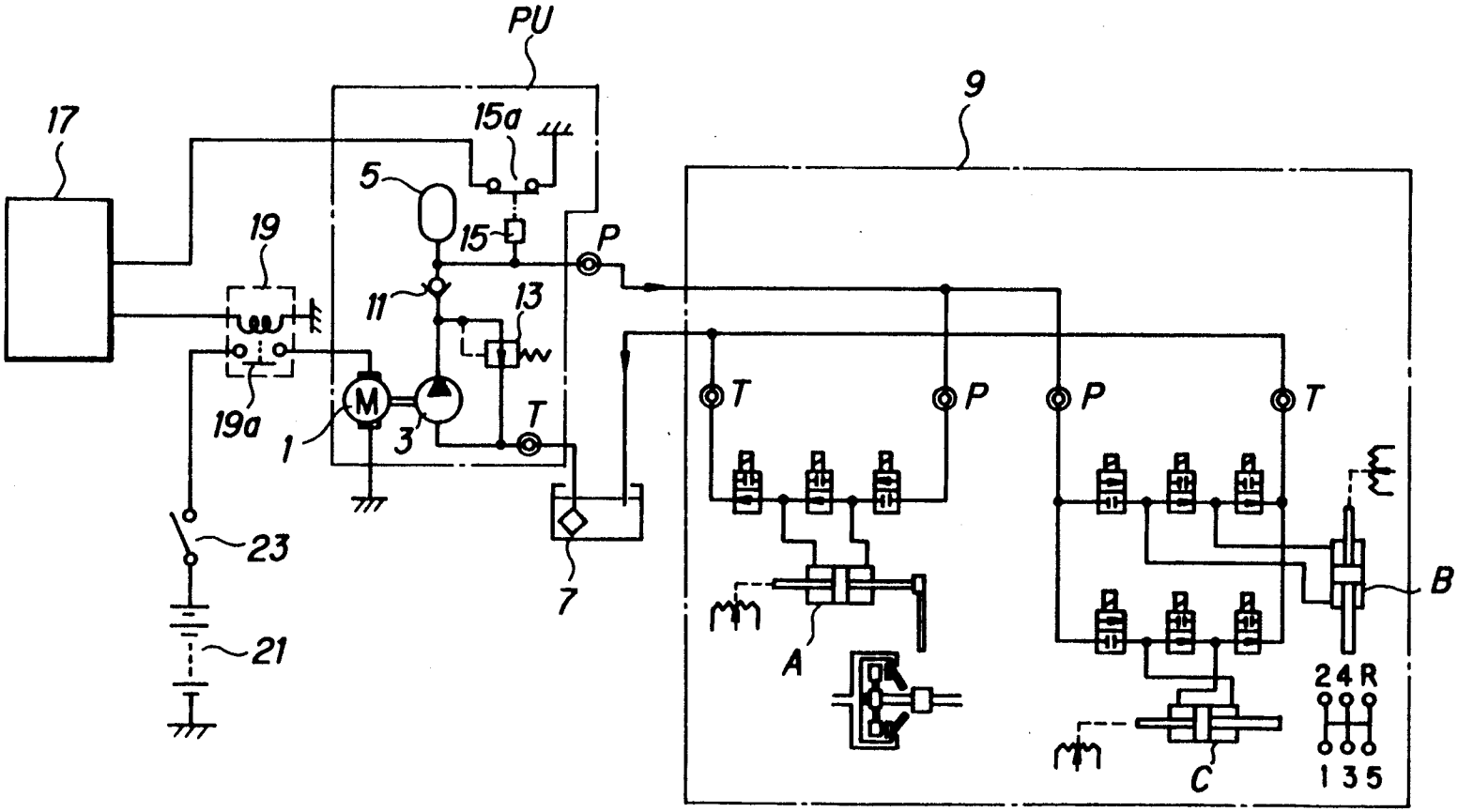
FIG. 8 PRIOR ART
FIG. 8 is a system diagram of a hydraulic power unit of conventional structure.
Figure 9:
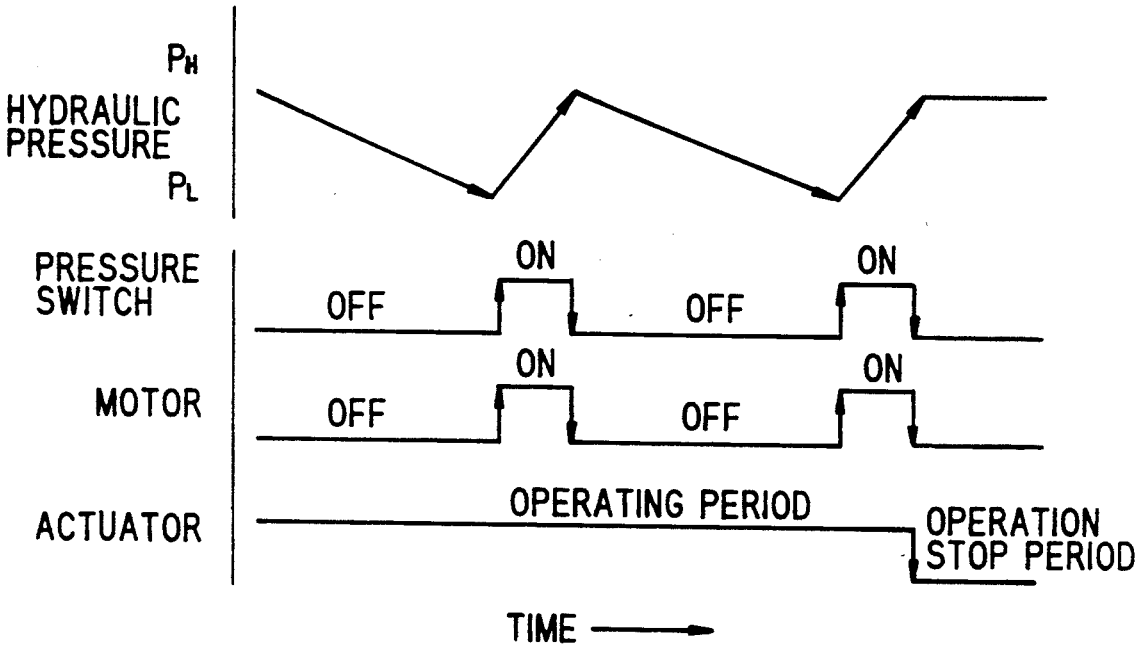
FIG. 9 PRIOR ART
FIG. 9 shows a time chart of a control flow of the hydraulic power unit of FIG. 8.

The hydraulic power unit adapted for a vehicle of the present invention will be described hereunder by way of a preferred embodiment with reference to FIGS. 1 to 6, in which like reference numerals are added to those corresponding to the elements or units shown in FIG. 8.

Figure 1:
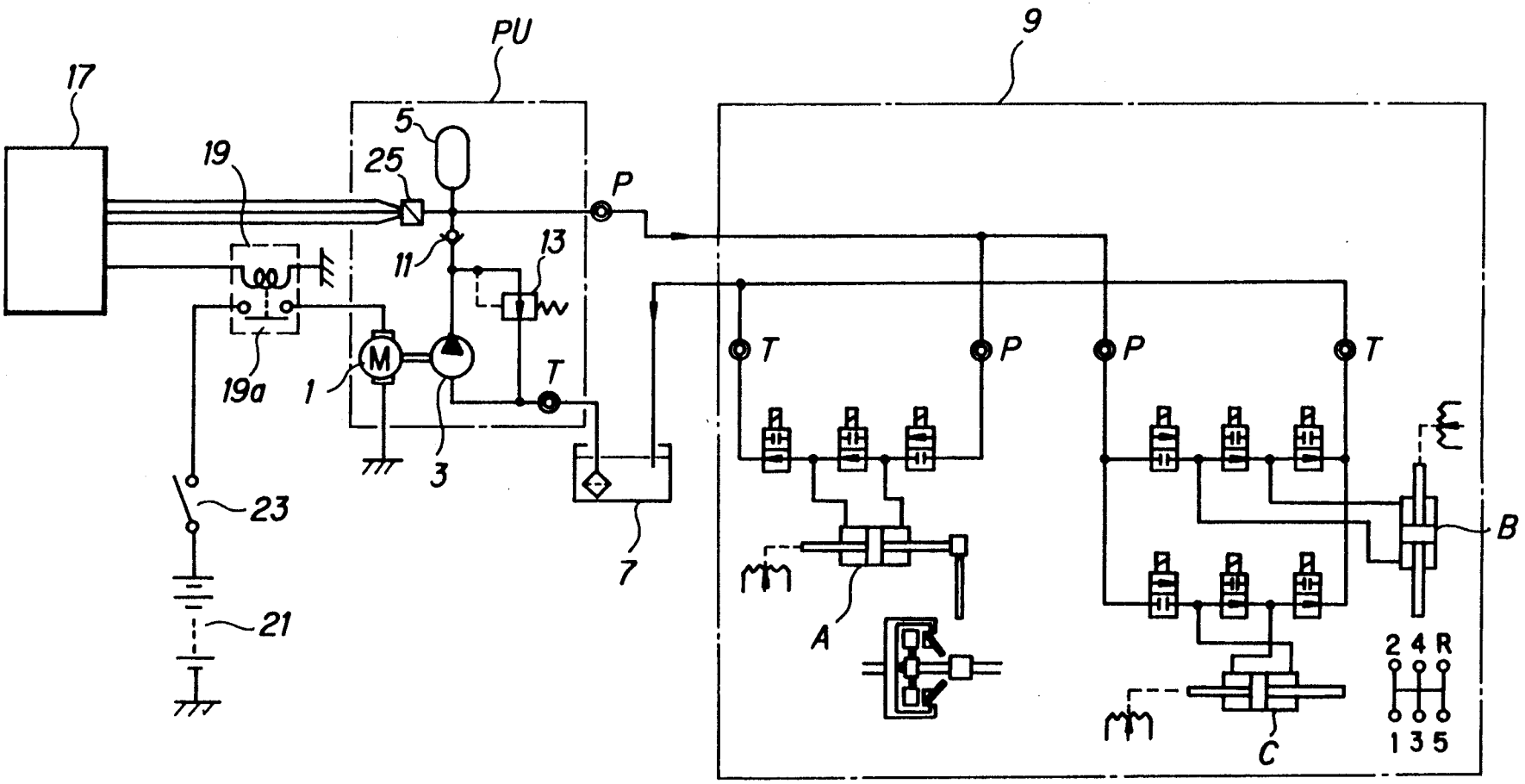
FIG. 1 is a system diagram of one embodiment of a hydraulic power unit according to the present invention.

Generally, as shown in FIG. 1, a hydraulic power unit PU of the present embodiment is provided with a motor 1, a gear pump 3 connected to the motor 1 through a line and a gas filling type accumulator 5 connected to the gear pump 3 through a line. In such arrangement, when the motor 1 is driven,, the gear pump 3 is operated to pump up the oil from an oil tank 7. The pumped-up oil is supplied to an actuator means 9 through a hydraulic line. The actuator means 9 includes a clutch changing cylinder A, a shift changing cylinder B, a select changing cylinder C and the like. A check valve 11 is also incporporated in the line connecting the accumulator 5 and the gear pump 3, and a relief valve 13 is incorporated in a line branched from the aforementioned line connecting he gear pump 3 and the accumulator 5.

In the hydraulic power unit PU of the present embodiment, a pressure sensor 25 is incorporated in a line at a portion near the outlet port of the accumulator 5 for linearly detecting the change of the hydraulic pressure in the hydraulic circuit. The pressure sensor 25 is electrically connected to a control unit 17 for controlling the whole opeation of the hydraulic power unit PU. The pressure sensor is composed of a electrostatic capacitance type pressure intershifter or convert, for example, and serves to intershift a change in capacitance between two electrodes caused by the change of the hydraulic pressure in the hydraulic circuit, into an electric voltage and to continuously output the thus intershifted voltage.

The control motion for the hydraulic power unit PU during the operation thereof will be described hereunder.

In the hydraulic system shown in FIG. 1, the motor 1 is not always driven even during the operation of the actuator means 9, and when a predetermined pressure is accumulated in the accumulator 5, the motor 1 is once stopped. During the motor operation stopping time, the actuator means 9 is operated by the pressure thus accumulated in the accumulator 5, whereas when the pressure in the accumulator 5 is lowered to or below the predetermined pressure, the motor 1 is again operated to drain the hydraulic oil and to operate the actuator means 9 by the drained oil.

Figure 2:
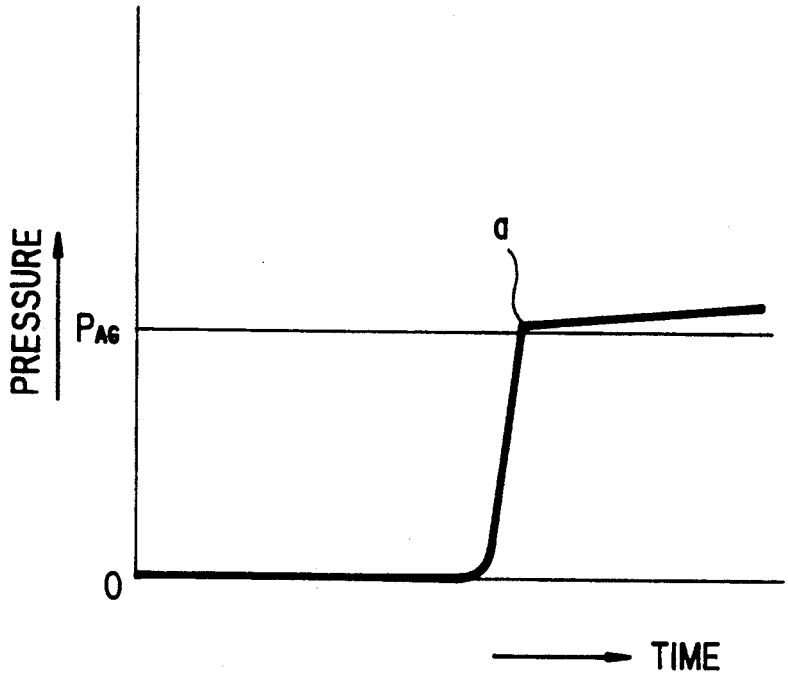
FIG. 2 is a graph showing a rate of change at a control starting time.
Figure 3:
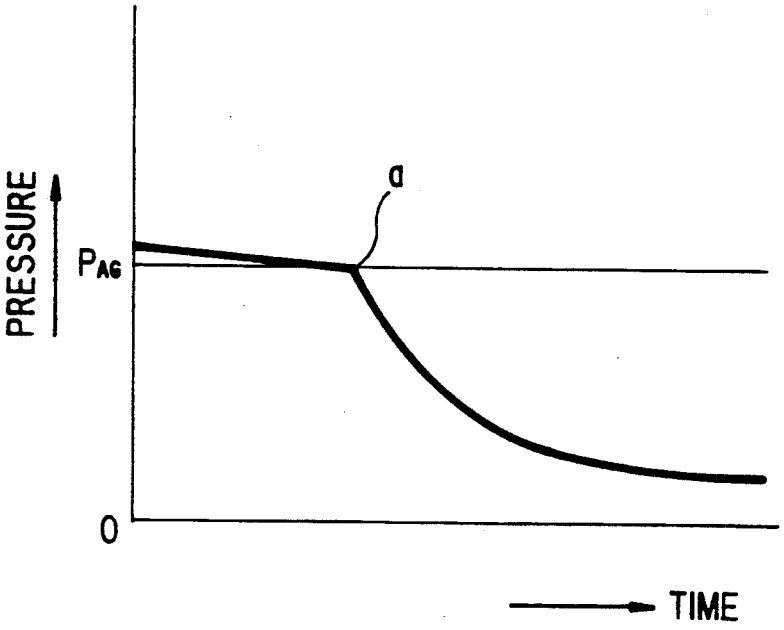
FIG. 3 is a graph showing a rate of change at a control stopping time.
Figure 4:
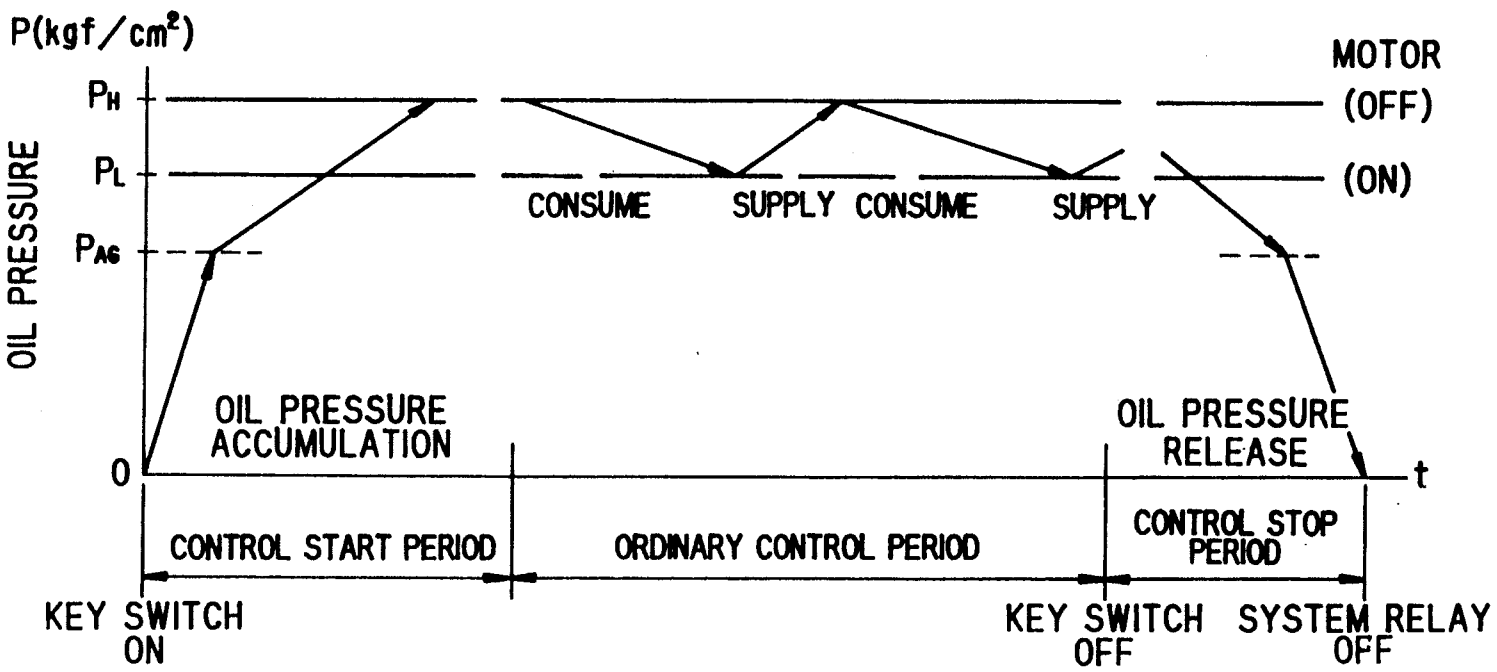
FIG. 4 shows a time chart of a control flow of the hydraulic power unit of FIG. 1.

Namely, further with reference to FIGS. 2 to 4, when the hydraulic pressure in the accumulator 5 reaches a high pressure level $P_H$, this pressure is detected by the pressure sensor 25 and an output power, i.e. voltage, corresponding to the pressure level $P_H$ is continuously outputted from the pressure sensor 25 to the control unit 17. In this operation, when the output voltage reaches a predetermined value of a high level voltage, the relay 19 is deenergized to thereby open the contact 19*a* thereof, thus stopping the operation of the motor 1. On the other hand, when the oil consumption due to the operation of the actuator means 9 progresses and the output voltage from the pressure sensor 25 lowers continuously to a predetermined voltage of a low level $P_L$, the control unit 17 operates to conduct the current to the relay 19 to thereby close the contact 19*a* thereof, thus driving the motor 1 again. To the relay 19 are operatively connected a battery 21 and a key switch 23.

In general, it is found as shown in FIG. 2, that at an operation starting time of the hydraulic power unit, the oil pressure in the hydraulic circuit of the hydraulic unit rapidly increases at the initial stage of the operation and then gently increases upon the arrival to a pressure $P_{AG}$ substantially corresponding to the pressure of the gas filling in the accumulator. Furthermore, at the operation stopping period, i.e. key switch "OFF" period, the oil in the accumulator 5 is all released into the oil tank 7, but in such case, the oil pressure gently decreases, as shown in FIG. 3, till the time when the accumulated oil pressure has reached a pressure corresponding to the gas pressure in the accumulator and then rapidly decreases upon the arrival to the gas pressure $P_{AG}$.

These operations will be described with reference to FIG. 4. Namely, at the control start time, the hydraulic pressure in the hydraulic circuit rapidly increases to the time of arriving to the gas pressure $P_{AG}$ in the accumulator 5 and then gently increases to the time of arriving to the high level pressure $P_H$. At this moment, the operation of the motor 1 stops. Thereafter, the control transits to the normal control mode as described above, and the motor 1 is switched on and off repeatedly, whereby the pressure of the oil in the accumulator 5 repeatedly changes between the high and low levels $P_H$ and $P_L$ to thereby consume and supply the oil alternately repeatedly. At the control stopping time period, the oil is all discharged into the oil tank 7, and in such case, the oil pressure rapidly decreases from the time when the accumulated pressure reaches the gas pressure $P_{AG}$.

According to this embodiment, in addition to the normal or ordinary control described above, the abnormal condition in a gas chamber of the accumulator 5 can be detected by utilizing either one of the characteristic features at the control start time or control stop time as represented by FIG. 2 or 3.

Figure 5:
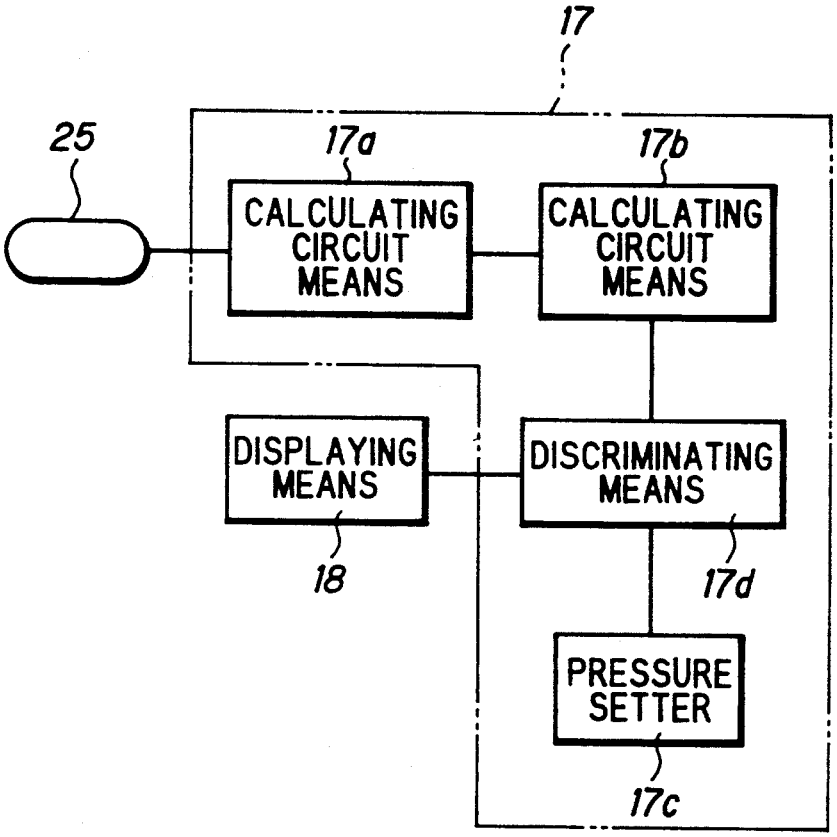
FIG. 5 is a block diagram of a system mainly composed of a control unit for detecting an abnormal gas pressure condition in an accumulator in the hydraulic power unit of the present invention.

FIG. 5 shows a block diagram of a system for detecting the gas pressure from the pressure sensor 25 and treating with the same and the system is mainly composed of a control unit 17. Referring to FIG. 5, the control unit 17 includes a calculating circuit means 17*a* for calculating a rate of change $\Delta p/\Delta t$ reprsenting the rate of the oil pressure continuously detected by the pressure sensor 25 with respect to the elapse of time, a further calculating circuit means 17*b* responsive to a signal from the first-mentioned calculating circuit means 17*a* for obtaining the inflection point a at which the rate of change $\Delta p/\Delta t$ is maximumly changed at the control start or stop time period and calculating the oil pressure at this inflection point a, a pressure setting means 17*c* in which a reference pressure substantially corresponding to the gas pressure in the accumulator 5 under the ordinary condition is preliminarily set, and a discriminating circuit means 17*d* which is operated in response to signals from the calculating circuit means 17*b* and the setting means 17*c* and in which the oil pressure at the inflection point a and the set reference pressure is compared with each other and a fact as to whether or not the oil pressure at the inflection point a calculated in the calculating circuit means 17*b* reaches the set pressure.

An alarm device such as display means 18 is connected to the discrimniating means 17*d* for informing the fact of the abnormal gas pressure condition of the accumulator 5 when the detected oil pressure does not reach the set pressure, and the relay 19 is also connected to the discriminating means 17*d*.

Figure 6:
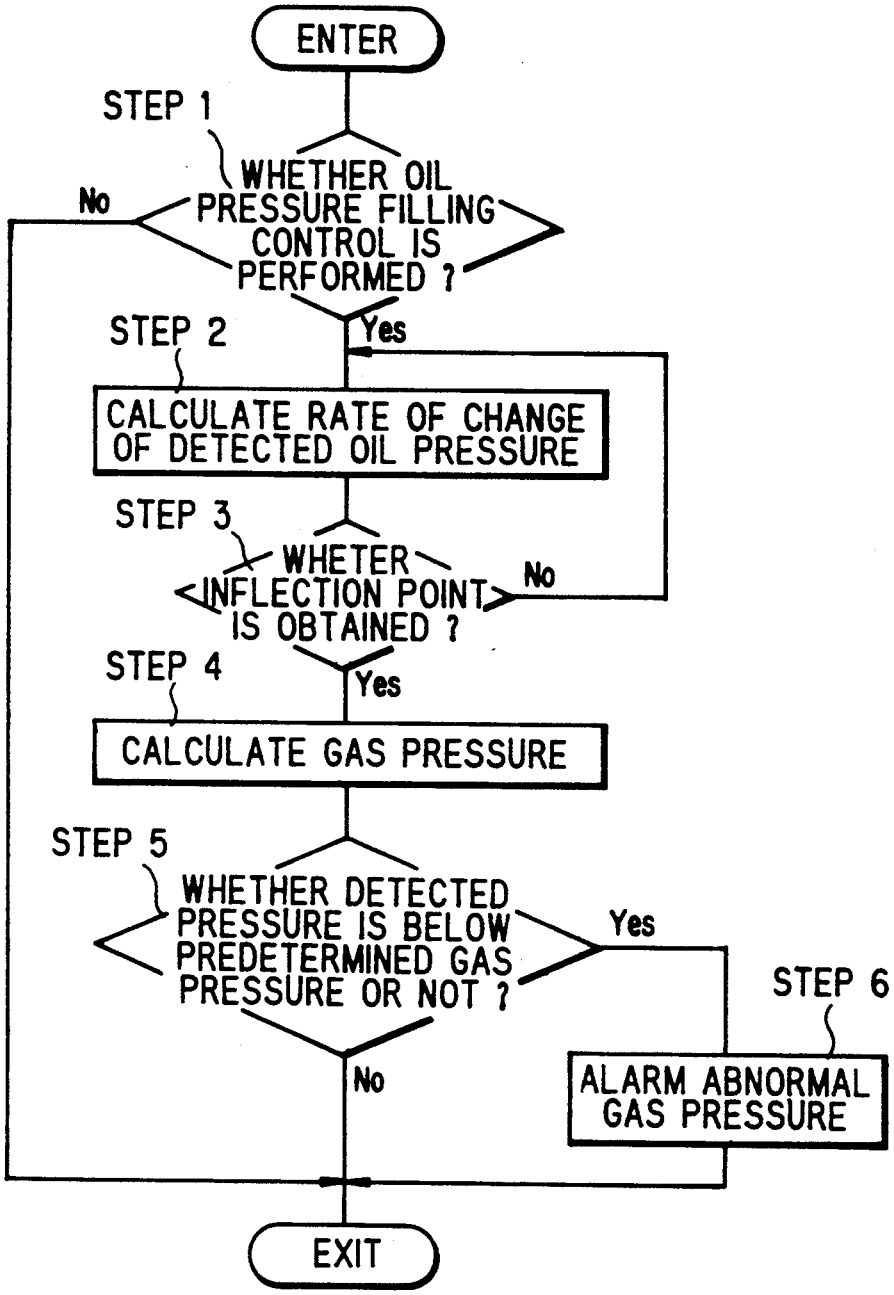
FIG. 6 is a flowchart for detecting abnormal condition of a gas pressure.

The control to detect an abnormality of the gas pressure is performed according to the present invention, which is shown in FIG. 6 by way of flowchart with reference to FIGS. 2 and 5.

Referring to FIG. 6, in step 1, after the start of the control, it is discriminated whether or not this control represents the oil pressure filling time to the accumulator 5, and in the case of "YES", the rate of change $\Delta p/\Delta t$, which is the rate of the oil pressure to be detected by the pressure sensor 25 with respect to the time, is continuously calculated in the step 2. This rate of change $\Delta p/\Delta t$, as shown in FIG. 2, has a large value till the time when the oil has been completely filled up in the accumulator 5, and when once completely filled up, that is, when the oil pressure reaches a value substantially equal to the gas pressure $P_{AG}$ in a gas chamber of the accumulator 5, the rate of change rapidly decreases thereafter.

In the step 3, this rate of change $\Delta p/\Delta t$ is checked to thereby obtain the inflection point a (FIG. 2) at which the rate of change is maximumly changed, and it is discriminated whether or not the rate of change calculated in the step 2 reaches to the inflection point a. In the case of "YES", the gas pressure at this time is first calculated in the step 4 and it is then discriminated whether or not the thus calculated gas pressure a reaches so-called set pressure in the step 5. In this step, the set pressure corresponds to the accumulated pressure in the accumulator 5 at the normal or ordinary operation time, i.e. a gas pressure in the gas chamber of the accumulator 5. At this discrimination, in a case where the gas pressure is below the set pressure, it is discriminated that the gas pressure in the gas chamber of the accumulator is in the abnormal condition, and hence, an alarm for informing of this abnormal condition is generated in the step 6. On the contrary, in a case where the gas pressure substantially corresponds to the set pressure, the control at the control start time has been completed, and thereafter, the operation proceeds to the usual control operation. The above mentioned steps are all controlled by way of the control unit 17.

According to the present invention, the abnormal condition of the gas pressure in the gas chamber of the accumulator 5 can be alarmed and displayed by the alarm means 18 such as display means, so that the operator can be easily informed of the gas pressure abnormal.

Figure 7:
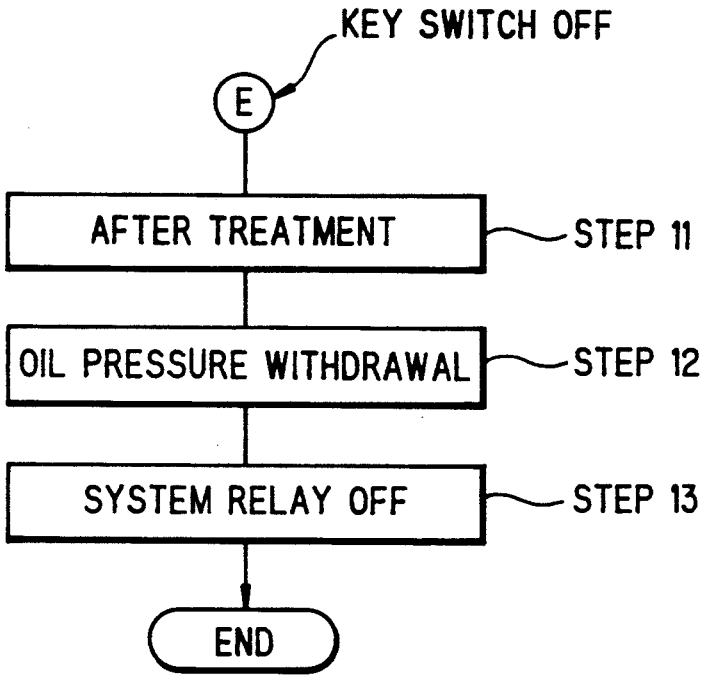
FIG. 7 is a flowchart for steps for stopping a vehicle at the time of detecting the abnormal pressure.

FIG. 7 is a brief flowchart for stopping a vehicle and this operation flow is concerned with the operation represented by the flowchart of FIG. 6. After the key switch 23 is made off, all the oil in the hydraulic circuit is returned to the oil tank 7 in the step 11. It is confirmed that no oil remains in the accumulator 5 in the next step 12 and the system relay is then made off in the step 13. Although this system relay is not shown in the drawings, it acts to connect the hydraulic power unit PU to the battery 21 for a predetermined time interval after the switch-off of the key switch 23.

According to these steps, after the operation of the vehicle stops, no oil remains in the accumulator 5, so that the gas pressure in the gas chamber of the accumulator 5 is necessarily at the inflection point a in FIG. 3, which is substantially equal to the gas filling pressure.

It is to be understood that the present invention is not limited to the described embodiment and many other changes or modifications may be made without departing from the scop of the appended claims.

WHAT IS CLAIMED IS

1. A hydraulic power unit comprising:

a motor means;

a pump means to be driven by the motor means to pump up an oil stored in an oil tank;

a gas filling type accumulator connected to the pump means through a line so as to supply the oil from the pump means;

a pressure detecting means disposed at a portion near an outlet port of the accumulator for detecting a pressure of the oil in the accumulator;

a control unit operatively connected to the pressure detecting means; and means operatively connected to the control unit for controlling an operation of the motor means, said control unit including means for calculating a rate of change of the pressure of the oil detected by the pressure detecting means with respect to transition of time, means for obtaining an inflection point at which the rate of change of the oil pressure at a time of control start time or control stop time of the hydraulic power unit is maximumly changed and calculating an oil pressure at the inflection point and means for comparing the oil pressure at the inflection point with a predetermined oil pressure and discriminating a fact as to whether or not the oil pressure at the inflection point reaches the predetermined oil pressure.

2. A hydraulic power unit according to claim 1, wherein said pressure detecting means comprises an electrostatic capacitance type pressure intershifter in which a change of capacitance caused in response to a change of hydraulic pressure in a hydraulic circuit is intershifted into a voltage and the intershifted voltage is continuously outputted.

3. A hydraulic power unit according to claim 1, wherein the means for controlling the motor operation comprises a relay means including a switching circuit for carrying out an on-off operation of the motor.

4. A hydraulic power unit according to claim 1, further comprises means for alarming an abnormal gas pressure condition in the accumulator.

5. A hydraulic power unit according to claim 4, wherein the alarming means is a display.

6. A hydraulic power unit according to claim 1, wherein the oil pressure control by means of the control unit is performed in connection with a gas pressure in the accumulator.

7. A hydraulic power unit according to claim 6, wherein the gas pressure in the accumulator corresponds to the predetermined oil pressure in an ordinary operation period of the accumulator.

8. A hydraulic power unit according to claim 6, wherein the pressure control is performed by utilizing a pressure versus time characteristic at a control start time.

9. A hydraulic power unit according to claim 3, wherein the pressure control is performed by utilizing a pressure versus time characteristic at a control stop time.

* * * * *